US005812499A

United States Patent [19]

Chen

[11] Patent Number: 5,812,499

[45] Date of Patent: Sep. 22, 1998

[54] TIME SETTING CONTROL MECHANISM FOR A MECHANICAL TIMER

[76] Inventor: Chan-Fu Chen, No.22-1, Lane 14, Ho-Ping Rd., Pan-Chiao City, Taipei Hsien, Taiwan

[21] Appl. No.: 987,425

[22] Filed: Dec. 9, 1997

[51] Int. Cl.[6] ..... G04F 1/00; G04C 21/16; H01H 43/10

[52] U.S. Cl. ..... 368/98; 368/254; 200/38 BA

[58] Field of Search ..... 368/10, 72–74, 368/97–100, 244, 247, 254, 269; 200/27 R, 30 R, 38 R, 3 BA, 38 D, 38 DA

[56] References Cited

U.S. PATENT DOCUMENTS

| | | |
|---|---|---|
| 3,951,007 | 4/1976 | Maulin . |
| 4,351,200 | 9/1982 | McElroy . |
| 4,363,943 | 12/1982 | Sorensen . |
| 4,504,154 | 3/1985 | Kammerer . |

*Primary Examiner*—Vit W. Miska
*Attorney, Agent, or Firm*—Bacon & Thomas

[57] ABSTRACT

A time setting control mechanism mounted in a mechanical timer and driven to automatically start or stop a machine at a given time, including, a hollow time counting wheel, a dial mounted in the time counting wheel, the dial having a center through hole, a disk mounted between the time counting wheel and the dial and supported on the time counting wheel by springy projecting strips thereof, the disk having an upward flange raised around the periphery, and a press portion raised from the center and protruding over the center through hole on the dial for pressing by hand, and a time setting control pin detachably mounted on the periphery of the time counting wheel, the time setting control pin having a mounting base detachably coupled to the periphery of the time counting wheel, a springy hook extended from the mounting base and inserted into an annular space defined between the upward flange of the disk and the periphery of the dial and hooked on a bottom edge of the dial, and a trigger rod adapted for triggering a switch of the mechanical timer to start or stop a machine at a given time, the spring hook of the time setting control pin being disengaged from the dial when the press portion of the disk is pressed down, permitting the time setting control pin to be removed from the time counting wheel.

7 Claims, 5 Drawing Sheets

TIME SETTING CONTROL MECHANISM FOR A MECHANICAL TIMER

BACKGROUND OF THE INVENTION

The present invention relates to a mechanical timer for automatically starting or stopping a machine or other device at a given time or for automatically controlling the operating interval, and more particularly to a time setting control mechanism for a mechanical timer which effectively prohibits the time setting control pin from escaping out of place or being removed from the mechanism by a child.

The time setting control mechanism of a regular mechanical timer is generally comprised of a time counting wheel driven by a driving mechanism through a transmission gear, and at least one time setting control pin respectively mounted on the time counting wheel and adapted for triggering a switch to start or stop a machine at a given time. The time setting control pin is detachable. When to set the desired time, the time setting control pin is plugged into a corresponding locating hole on the time counting wheel. Because the time setting control pin is detachable, it tends to fall from the time counting wheel. Furthermore, because the time setting control pin can be easily disconnected from the time counting wheel by a child, a child may take the time setting control pin away from the time counting wheel and put it in the mouth.

SUMMARY OF THE INVENTION

The present invention provides a time setting control mechanism which eliminates the aforesaid problems. According to one aspect of the present invention, the time setting control mechanism comprises a hollow time counting wheel, a dial mounted in the time counting wheel, the dial having a center through hole, a disk mounted between the time counting wheel and the dial and supported on the time counting wheel by springy projecting strips thereof, the disk having an upward flange raised around the periphery, and a press portion raised from the center and protruding over the center through hole on the dial for pressing by hand, and a time setting control pin detachably mounted on the periphery of the time counting wheel, the time setting control pin having a mounting base detachably coupled to the periphery of the time counting wheel, a springy hook extended from the mounting base and inserted into an annular space defined between the upward flange of the disk and the periphery of the dial and hooked on a bottom edge of the dial, and a trigger rod adapted for triggering a switch of the mechanical timer to start or stop a machine at a given time. According to another aspect of the present invention, the time setting control pin can be conveniently removed from the time counting wheel by: pressing down the press portion of the disk, then pressing the springy hook inwards to disengage the springy hook from the bottom edge of the dial.

DETAILED DESCRIPTION OF THE PREFERRED EMBODIMENT

Figure 1:
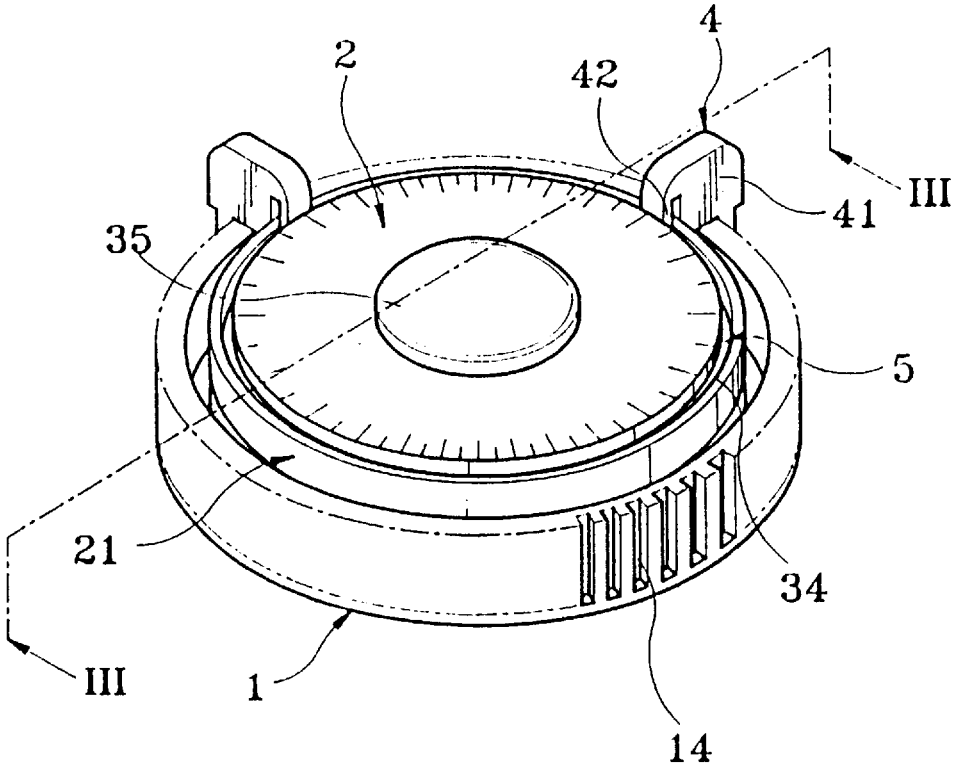
FIG. 1 is a perspective view of a time setting control mechanism for a mechanical timer according to the present invention.
Figure 2A:
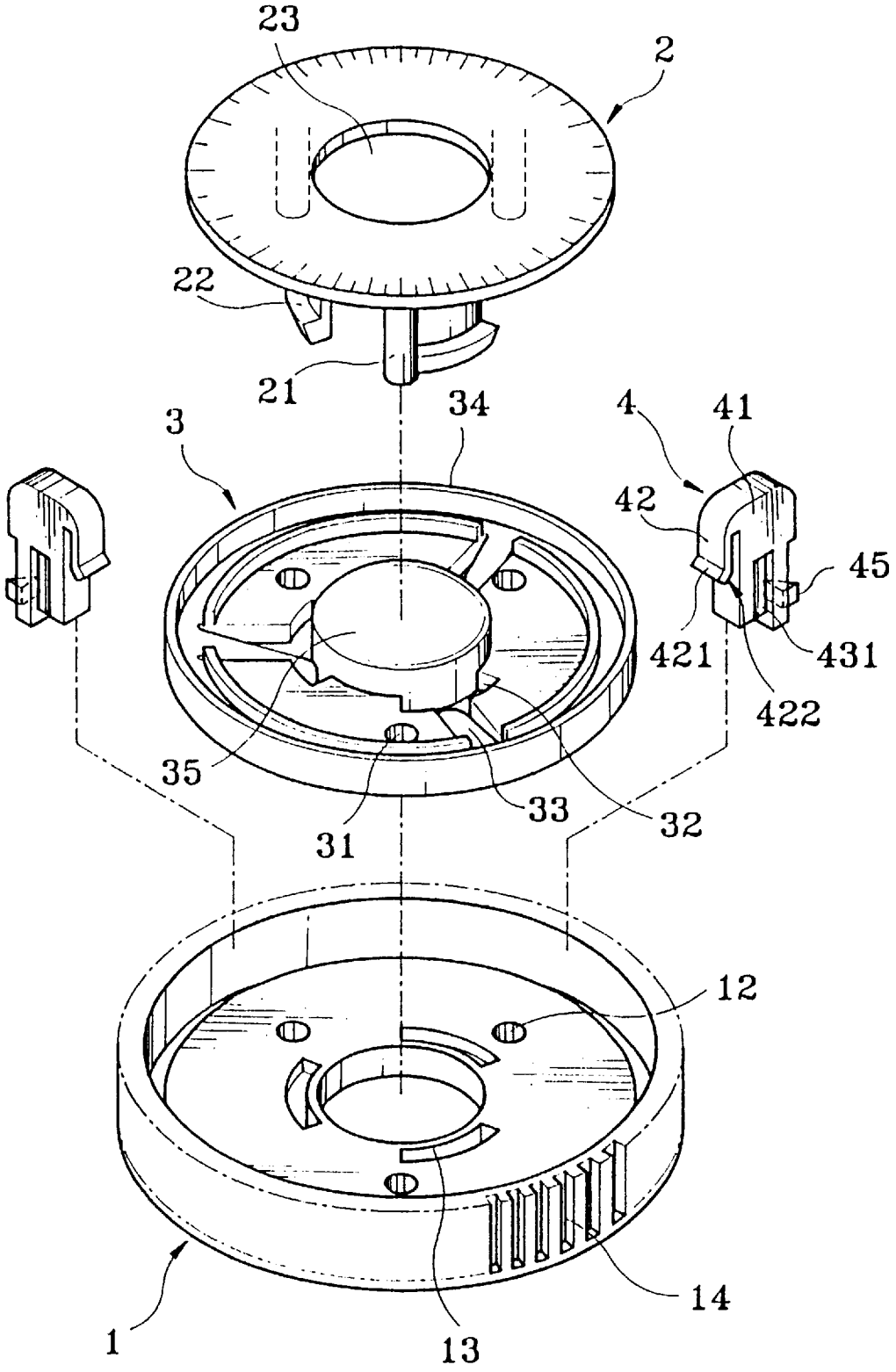
FIG. 2A is an exploded view of the time setting control mechanism shown in FIG. 1.
Figure 2B:
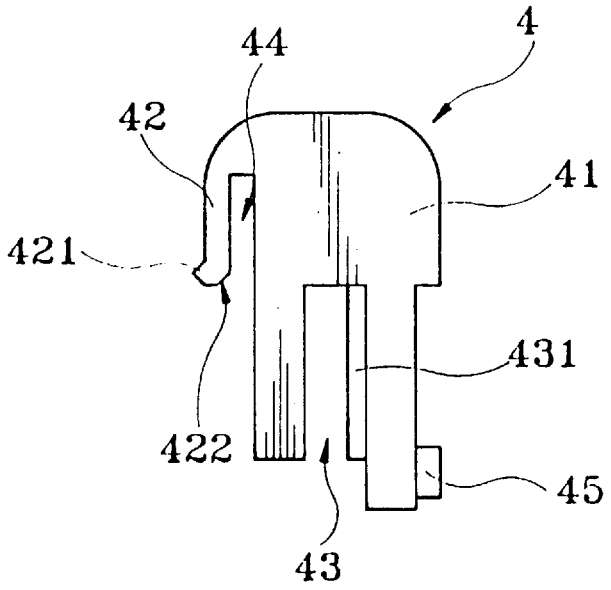
FIG. 2B is an enlarged view of the time setting control pin according to the present invention.
Figure 3:
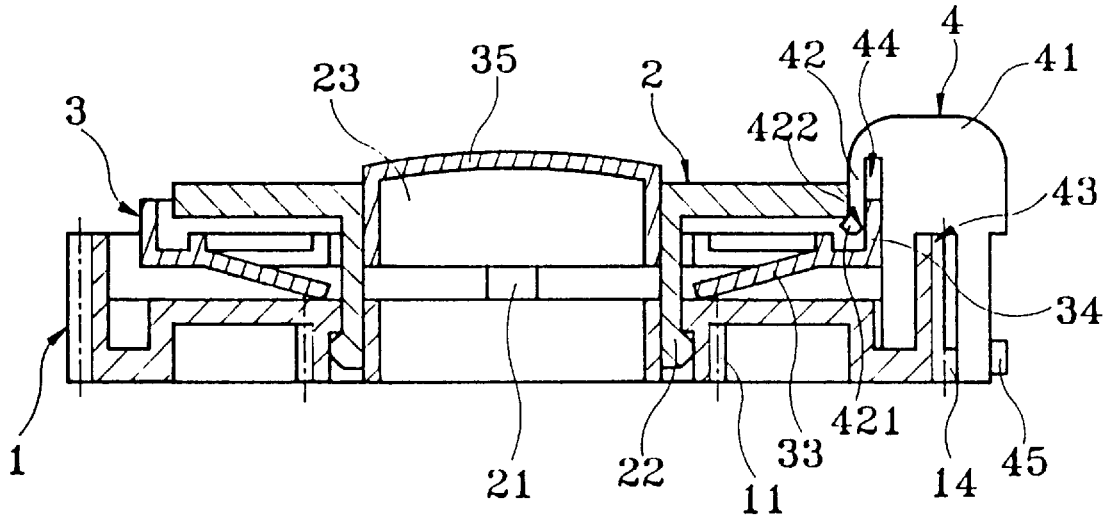
FIG. 3 is a sectional view taken along line III—III of FIG. 1.

Referring to FIGS. 1, 2A, 2B and 3, a time setting control mechanism for a mechanical timer in accordance with the present invention is generally comprised of a time counting wheel 1, a dial 2 mounted in the time counting wheel 1, a disk 3 mounted between the time counting wheel 1 and the dial 2, and at least one time setting control pin 4 mounted on the periphery of the time counting wheel 1.

The time counting wheel 1 is a hollow rounded wheel comprising a gear 11 at the center meshed with a transmission gear of the driving mechanism of the mechanical timer for permitting the time counting wheel 1 to be turned by the driving mechanism of the mechanical timer, a plurality of pin holes 12 and locating slots 13 spaced around the gear 11, and axially extended grooves 14 spaced around the periphery.

The dial 2 comprises a plurality of downwardly extended locating pins 21 and retainers 22 respectively forced into engagement with the pin holes 12 and locating slots 13 on the time counting wheel 1, and a center through hole 23.

The disk 3 comprises a plurality of pin holes 31 and slots 32 through which the locating pins 21 and retainers 22 of the dial 2 pass respectively, a plurality of springy supporting means for example springy projecting strips 33 raised from its bottom side and pressed against the inside wall of the time counting wheel 1 to support the disk 3 on the time counting wheel 1, an upward flange 34 raised around the border, and a press portion 35 raised from the center and protruding over the center through hole 23 on the dial 2. The inner diameter of the upward flange 34 of the disk 3 is greater than the diameter of the dial 2, therefore an annular space 5 is defined within the upward flange 34 of the disk 3 around the periphery of the dial 2. The springy projecting strips 33 are preferably integral with the bottom wall of the disk 3. When the disk 3 is pressed down, the springy projecting strips 33 are deformed. After the downward pressure has been released from the disk 3, the springy projecting strips 33 immediately return to their former shape, thereby causing the disk 3 to be lifted to its former position.

The time setting control pin 4 comprises a mounting base 41, a springy hook 42 extended from the mounting base 41 and terminating in a hooked portion 421 and a sloping bottom guide face 422, a retaining hole 44 defined between the mounting base 41 and the springy hook 42 and forced into engagement with the upward flange 34 of the disk 3, a bottom coupling hole 43 forced into engagement with the periphery of the time counting wheel 1, a longitudinal locating rib 431 disposed inside the bottom coupling hole 43 and forced into engagement with one axially extended groove 14 on the periphery of the time counting wheel 1, and a trigger rod 45 raised from the mounting base 41 at a back side remote from the springy hook 42 and adapted for trigging a switch of the mechanical timer to automatically start or stop a machine.

Figure 4A:
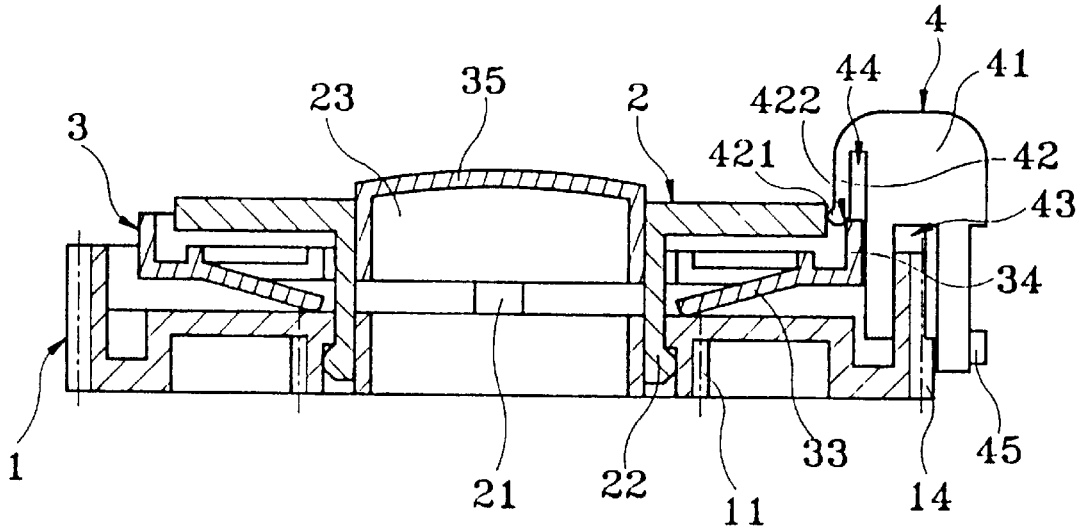
FIG. 4A is a sectional assembly view of the present invention, showing the installation of the time setting control pin.

Referring to FIG. 4A and FIGS. 1 and 3 again, when the bottom coupling hole 43 and retaining hole 44 of the time setting control pin 4 are respectively aimed at the periphery of the time counting wheel 1 and the upward flange 34 of the disk 3, the time setting control pin 4 is pressed down to force the bottom coupling hole 43 and retaining hole 44 of the time setting control pin 4 into engagement with the periphery of the time counting wheel 1 and the upward flange 34 of the disk 3 respectively, and at the same time the springy projecting strips 33 are pressed against the inside wall of the time counting wheel 1 and deformed. By means of the guidance of the sloping bottom guide face 422, the springy hook 42 can be smoothly forced into the annular space 5 (see FIG. 4A). After the springy hook 42 has been inserted into the annular space 5 and the time setting control pin 4 has been released from the hand, the springy projecting strips 33 immediately return to their former shape to lift the disk 3 from the time counting wheel 1, thereby causing the hooked portion 421 of the springy hook 42 to hook on the bottom edge of the dial 2 (see FIG. 3), and therefore the time setting control pin 4 is prohibited from pulling out of the time counting wheel 1. This design prevents the time setting control pin 4 to be taken away from the time setting control mechanism by a child.

Figure 4B:
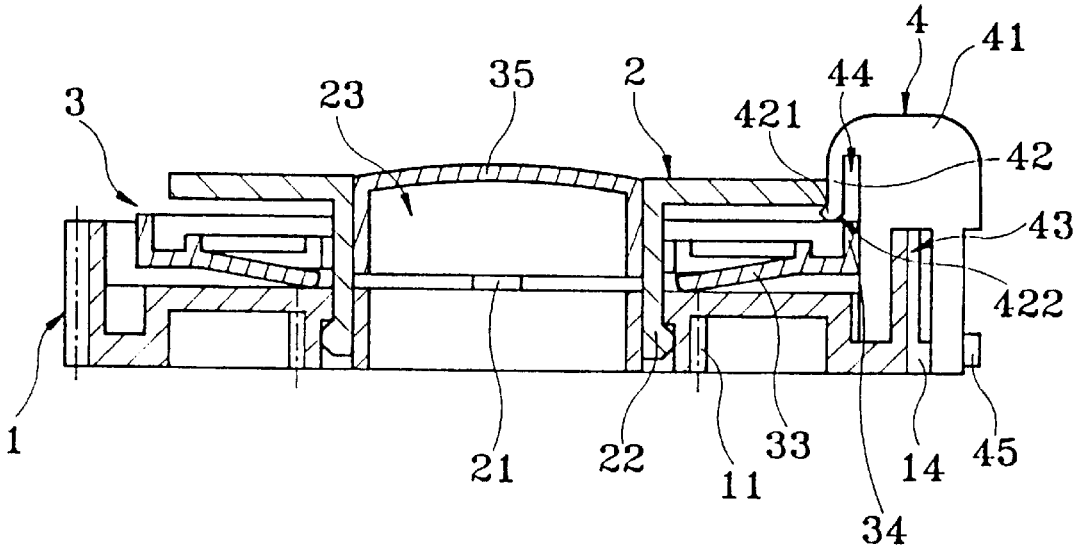
FIG. 4B is a schematic drawing showing the press portion of the disk pressed down, the springy projecting strips of the disk deformed according to the present invention.
Figure 4C:
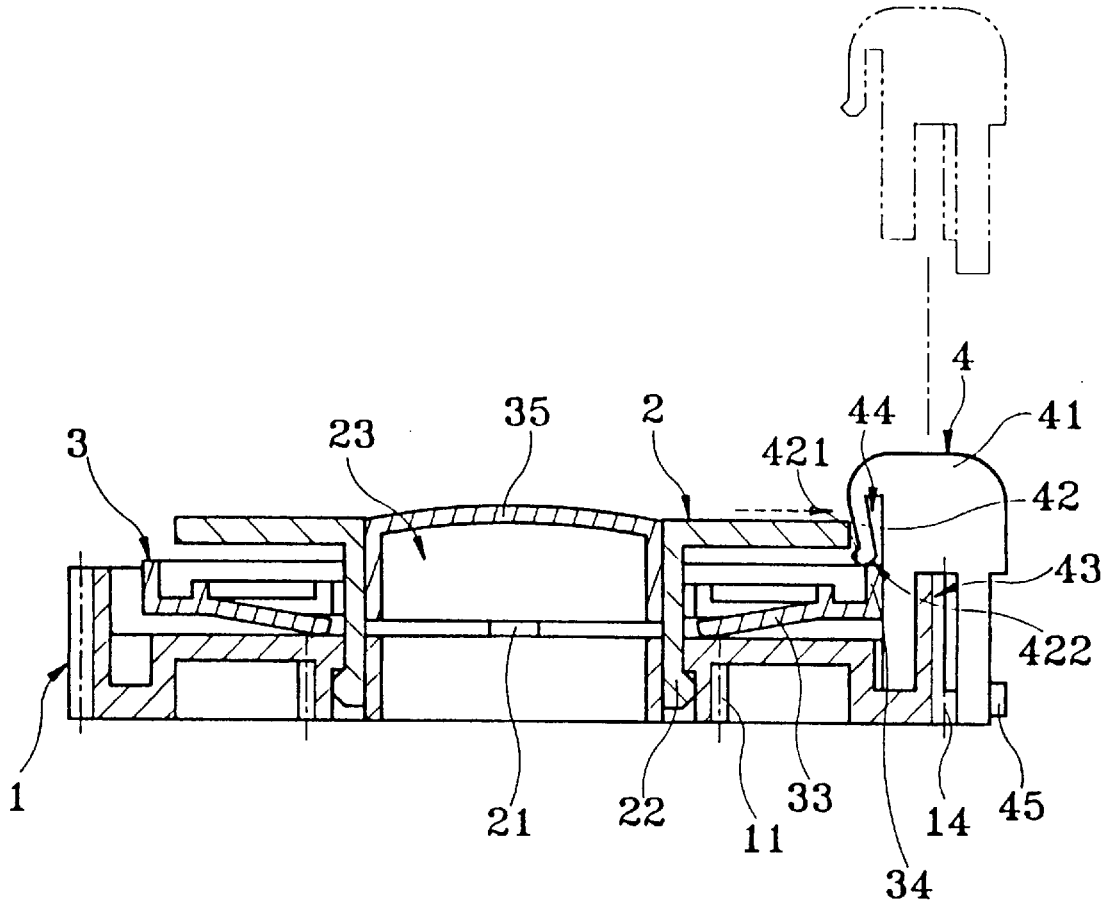
FIG. 4C is a schematic drawing showing the springy hook of the time setting control mechanism pressed inwards and disengaged from the bottom edge of the dial according to the present invention.

Referring to FIGS. 4B and 4C, the time setting control pin 4 can be disconnected from the time counting wheel 1, and then shifted to another location on the time counting wheel 1 to change starting or stopping time of the machine being controlled by the mechanical timer. When to disconnect the time setting control pin 4 from the time counting wheel 1, the press portion 35 of the disk 3 is pressed down to disengage the upward flange 34 from the retaining hole 44 on the time setting control pin 4, then the springy hook 42 is pressed inwards toward the mounting base 41 to disengage the hooked portion 421 from the bottom edge of the dial 2, and then the time setting control pin 4 is pulled upwards to disengage the longitudinal locating rib 431 from the corresponding axially extended groove 14, and therefore the time setting control pin 4 is removed from the time setting control mechanism.

While only one embodiment of the present invention has been shown and described, it will be understood that various modifications and changes could be made thereunto without departing from the spirit and scope of the invention disclosed.

What the invention claimed is:

1. A time setting control mechanism mounted in a mechanical timer and driven to automatically start or stop a machine at a given time, comprising:

a hollow time counting wheel;

a dial mounted in said time counting wheel, said dial having a center through hole;

a disk mounted between said time counting wheel and said dial, said disk comprising an upward flange raised around the periphery, a press portion raised from the center and protruding over the center through hole on said dial for pressing by hand, springy supporting means raised from a bottom side thereof and adapted for supporting on an inside wall of said time counting wheel, the upward flange of said disk defining with the periphery of said dial an annular space; and at least one time setting control pin mounted on the periphery of said time counting wheel, each of said at least one time setting control pin comprising a mounting base coupled to the periphery of said time counting wheel, a springy hook extended from said mounting base and inserted into the annular space defined between the upward flange of said disk and the periphery of said dial, said springy hook having a hooked portion at a bottom end thereof hooked on a bottom edge of said dial.

2. The time setting control mechanism of claim 1, wherein said time counting wheel comprises a plurality of locating slots; said disk comprises a plurality of slots corresponding to the locating slots on said time counting wheel; said dial comprises a plurality of retainers respectively raised from a bottom side thereof, said retainers being respectively inserted through the slots on said disk and forced into engagement with the locating slots on said time counting wheel.

3. The time setting control mechanism of claim 1, wherein said springy supporting means of said disk comprises a plurality of springy projecting strips raised from said disk at a bottom side and adapted for supporting said disk on said time counting wheel.

4. The time setting control mechanism of claim 1, wherein said springy supporting means of said disk comprises a plurality of compression springs adapted to support said disk on said time counting wheel.

5. The time setting control mechanism of claim 1, wherein the mounting base of each of said at least one time setting control pin defines with the corresponding springy hook a retaining hole for receiving the upward flange of said disk, having a bottom coupling hole adapted for receiving the periphery of said time counting wheel.

6. The time setting control mechanism of claim 1, wherein each of said at least one time setting control pin comprises a trigger rod raised from the corresponding mounting base at a back side and adapted for trigging a switch of the mechanical timer to automatically start or stop the machine.

7. The time setting control mechanism of claim 1, wherein the springy hook of each of said at least one time setting control pin has a slopping bottom guide face adapted for guiding the respective springy hook into the annular space defined between the upward flange of said disk and the periphery of said dial.

* * * * *